United States Patent [19]

Ruchel

[11] 4,226,621

[45] Oct. 7, 1980

[54] BRASS MATERIAL AND A PROCESS FOR THE PREPARATION THEREOF

[75] Inventor: Peter Ruchel, Lauf, Fed. Rep. of Germany

[73] Assignee: Diehl GmbH & Co., Nuremberg, Fed. Rep. of Germany

[21] Appl. No.: 941,131

[22] Filed: Sep. 11, 1978

[30] Foreign Application Priority Data

Sep. 17, 1977 [DE] Fed. Rep. of Germany ..... 2742008

[51] Int. Cl.[3] ..... C22C 9/04; C22F 1/08

[52] U.S. Cl. ..... 75/157.5; 148/11.5 C; 148/12.7 C

[58] Field of Search ..... 75/157.5; 148/11.5 C, 148/12.7 C, 160, 32, 32.5

[56] References Cited

U.S. PATENT DOCUMENTS

| | | | |
|---|---|---|---|
| 2,050,601 | 8/1936 | Ellis | 148/160 |
| 2,145,065 | 1/1939 | Vaders | 148/160 |
| 3,046,166 | 7/1962 | Hartmann | 148/115 C |
| 3,615,922 | 10/1971 | Alyea | 75/157.5 |
| 3,963,526 | 6/1976 | Lunn | 75/157.5 |

FOREIGN PATENT DOCUMENTS

| | | | |
|---|---|---|---|
| 543830 | 7/1957 | Canada | 148/11.5 C |

*Primary Examiner*—L. Dewayne Rutledge
*Assistant Examiner*—Peter K. Skiff
*Attorney, Agent, or Firm*—Scully, Scott, Murphy & Presser

[57] ABSTRACT

A brass material and a process for the preparation thereof, which comprises an alloy of 61 to 65% by weight of copper with the remainder being zinc; the material evidencing a structure in which the recrystallized phases $\alpha$ and $\beta_1$ are present in a discrete fine mixture having grain sizes of less than 5 $\mu$m. The component of the $\beta_1$ phase comprises at least 10% of the structure and is arranged in the form of discrete particles in the grain boundaries of the $\alpha$ phase.

5 Claims, No Drawings

BRASS MATERIAL AND A PROCESS FOR THE PREPARATION THEREOF

BACKGROUND OF THE INVENTION

1. Field of the Invention

The present invention relates to a brass material and a process for the preparation thereof.

2. Discussion of the Prior Art

From German Published Patent Specification No. 12 28 810 there has already become known a process for the preparation of materials, in this instance spring materials, which are constituted of copper-zinc alloys. In this process, a semifinished material produced from a copper-zinc alloy in a method commonly employed for malleable alloys is annealed, cold worked and then subjected to a temperature and time-measured heat treatment. Hereby, the treatment is regulated so that there will be avoided a recrystallization of the material matrix.

The spring materials which are obtained in this manner evidence an increased, extensively isotropic spring flexural limit. However, in general, this known process need not improve the mechanical properties of commercial brass alloys to a considerable extent so as to render them applicable for the increased demands thereon. Finally, this is not only documented by the fact that such alloys, in an increasing measure, must be replaced by materials which are expensive and difficult to machine or process. Moreover, the usual commercial brass alloys are unsuitable for further processing through a superplastic deformation.

The preparation process which has become known from the above-mentioned patent publication, which does not in any way provide for a material suitable for a superplastic deformation, additionally requires an extremely precise maintenance of the temperature as well as of the time period for the heat treatment. Thus, even small deviations from the predetermined annealing temperature lead to an undesirable reduction in the mechanical properties of the material.

As a consequence, above all also due to the good electrical conductivity of the brass, there is thus present a great interest in a simply and inexpensively producible brass material which, in contrast with the traditional brass alloys, evidences a substantially improved deformability as well as occasionally considerably improved mechanical properties.

SUMMARY OF THE INVENTION

Accordingly, it is an object of the present invention to provide an inexpensive brass material which, predicated on its structure and its mechanical properties, can be further processed as good as is possible, in particular through superplastic deformation, and which renders it possible to also produce high-strength and highly ductile workpieces. A further object of the present invention contemplates the provision of a process for the preparation of such a brass material.

The foregoing invention achieves this object in that it contemplates a material which is constituted of an alloy having 61 to 65%, preferably 62% by weight of copper, with the remainder being zinc, and which evidences a structure in which the recrystallized phases $\alpha$ and $\beta_1$ are present as a discrete fine mixture with grain sizes of less than 5 $\mu$m, wherein the $\beta_1$-phase component consists of at least 10% and this phase is arranged in the form of discrete particles in the grain boundaries of the $\alpha$ phase.

In its preferred embodiment, the brass material prepared pursuant to the invention evidences 10 to 50%, preferably about 30 to 40% of the $\beta_1$ phase in the cohesive $\alpha$ matrix which is subdivided through grain boundaries. In this composition, the superfinely recrystallized structure is particularly stable with regard to temperature increases, as well as also with regard to an exceeding of the annealing time period. This provides a particularly advantageous effect in an eventual subsequent further processing through the intermediary of superplastic deformation.

As a result of its extremely fine-grained, crystalline structure, a so-called microduplex structure, the inventive brass material is almost ideally extensively cold workable (>99%). In connection with the small crystal size it is hereby possible to obtain for brass heretofore unknown values with respect to hardness and strength. Thus, after a final cold working or forming of at least 70%, the inventive material evidences a hardness in excess of 220 HV (Vickers hardness), a tensile strength>800 N/mm$^2$ and a 0.2% yield strength>600 N/mm$^2$. Due to its almost unlimited deformation capability, this material is hereby particularly well suited for additional shaping processes. This good further workability is documented in that the material which has been converted into the spring-hardened condition, evidences a reduction of area of about 60% in combination with the above-mentioned mechanical properties. Furthermore obtained for this spring material, similarly required through the superfine grain as well as by the presence of a second phase, is a substantially enhanced fatigue strength.

The process for the preparation of the inventive brass material makes use of the well known fact that the copper-zinc binary system evidences, for copper contents of between 61 and 70% in the temperature range of between 450° and 500° C., a maximum solubility of the $\beta/\beta_1$ phases in the $\alpha$ solid solution. As a consequence of the decrease of this solubility toward lower temperatures there must thus result during the cooling a precipitation of the $\beta_1$ phase from the quite supersaturated $\alpha$ solid solution whereby there is theoretically produced the possibility of a precipitation hardening.

However, in actual practice, the setting up of the equilibrium between the $\alpha$ and $\beta_1$ phases at low temperatures is so strongly hindered through the reduction in the diffusion, also as well as through inhomogeneity, metastable conditions and so forth, that it takes place over extremely lengthy time spans. Thus, it had heretofore been assumed that, at 250° C., there was required an annealing period of about one year until the setting up of the equilibrium between the two phases corresponding to this temperature. (Compare hereby, for example: T. B. Massalski and J. E. Kittl; J. Austral. Inst. of Metals, 8, 1963, 91-97.) A technological application of the precipitation of the $\beta_1$ phase from an $\alpha$ solid solution appeared to be thereby precluded.

Nevertheless, it is indicated that for bran alloys having the inventive composition, a precedently effected cold working or forming of at least 50% will tend to greatly accelerate the speed of the $\beta_1$ precipitation. The annealing periods which are required for the complete $\beta_1$ precipitation and the subsequent recrystallization, depending upon the composition and the degree of the previous cold working as well as the annealing temperature, now lie at between one minute and 500 hours, for the preferred annealing temperatures at between one and eight hours. Due to the extremely fine initial distribution of the $\beta_1$ phase in the $\alpha$ parent phase, after the completed recrystallization there will arise a superfine, two-phased structure, in which two phases are present with grain sizes of less than 5 $\mu$m. Since the two phases will permanently inhibit grain growth due to their interaction, this microduplex structure will remain stable even at higher temperatures.

DETAILED DESCRIPTION

Described hereinbelow is the preferred process for the preparation of the inventive brass material.

Proceeding from an alloy with preferably 62% copper with the remainder being zinc, through the intermediary of casting and extruding there is produced the semi-finished material which serves as the base for effectuation of the subsequent processing. Hereby, any kind of suitable casting procedure, for instance, such as continuous casting, can be employed, but it is also possible to contemplate other methods of hot working, such as hot rolling, or also a partial cold forming.

The thus present semi-finished brass material is thereafter annealed in order to ensure that a solid solution of $\alpha$ only is now available for further processing. The annealing is effected in a temperature range of between 450° and 500° C., within the range of the $\alpha$ solid solution only. The annealing period consists of about 20 hours.

Suitable for the subsequent cold working of the material is basically any process hitherto known for this purpose, such as rolling, drawing or hammer forging. Of importance is only that there is hereby reached a degree of deformation of at least 50%, however, preferably in excess of 80%. In the preferred preparation process, the semi-finished brass material is deformed by means of cold rolling at a degree of deformation of 90%. Concurrently, the degree of the cold working is herein the measure for the intensity of the subsequent heat treatment which is intended to effect the precipitation of the $\beta_1$ phase as well as the recrystallization of the matrix.

At a precedent cold working or deformation of about 90%, the recrystallization is completed after an annealing period of four hours and an annealing temperature of 250° C. The alloy is now present as a superfine two-phased structure with uniform grain sizes of 1 to 2 $\mu$m, meaning, it is present as a microduplex structure.

As a result of the heat treatment up to complete recrystallization, a part of the material hardness which had been obtained through the extensive cold working and the $\beta_1$ precipitation, will again be lost. Therefore, insofar as is intended to obtain a material having a special hardness, there is required a renewed cold working subsequent to the precipitation and recrystallization annealing, whereby the degree of deformation orients itself pursuant to the desired end hardness. Due to its extremely fine-grained structure, the brass material of the invention evidences a high cold workability so that, at such a final cold working, deformation degrees of over 99% are possible without the brittleness of the material becoming disturbing in appearance.

However, on the other hand, it is also possible to submit the obtained brass material after the effected recrystallization to a superplastic deformation at temperature of up to 350° C., whereby, as a result of the good temperature stability of the microduplex structure, no substantial grain coarsening is encountered. The super-fine grain affords that, with low deformation forces, there may be attained relatively great deformations, even into complicated configurations.

Whereas it is possible for alloys with copper contents of higher than 62% by weight to reduce the time period for the annealing in the range of the $\alpha$ solid solution through the selection of correspondingly higher annealing temperatures (up to 700° C.), depending upon circumstances, to less than one hour, for the preferred composition, due to the plot of the equilibrium line $\alpha/(\alpha+\beta)$, it is not possible to anneal at more than 500° C. However, in a modification of the presently described process, for the preparation of the inventive brass material it is possible to shorten the annealing period for the annealing in the range of the $\alpha$ solid solution in that the semi-finished material, preceding this first annealing, is at first subjected to an additional cold working or deformation of about 50%. The annealing period for the annealing in the range of the $\alpha$ solid solution at 450° to 500° C. is then reduced to about one hour.

As has already been mentioned, the inventive brass material is particularly suited also for the production of high-strength workpieces, in particular, springs. For this purpose, in order to convert the material into the final spring-hardened condition there is carried out, following the precipitation and recrystallization annealing leading to the formation of the microduplex structure, a subsequent cold deformation of about 80% which, for instance, can be effectuated through cold rolling or drawing.

When during the final cold working there are employed degrees of deformation in excess of 70%, preferably 80 to 99%, it is then possible to achieve a hardness of over 220 HV at a tensile strength $> 800$ N/mm$^2$ and a 0.2% yield strength $> 600$ N/mm$^2$. On the other hand, the still remaining capability of changes in configuration facilitates the utilization of additional forming procedures, for example, in the manufacture of screws, particularly cross-slotted or Phillips-head screws.

In a further embodiment of the inventive material preparation process, the alloy contains a recrystallization retarding additive of nickel in an amount of up to 5% by weight. This prevents too rapid a recrystallization sequence, occurring especially during heat treatments at higher annealing temperatures and which will prematurely disrupt the $\beta_1$ precipitation prior to the reaching of the equilibrium condition. For the same purpose it is also possible to utilize an addition of zirconium, silver, niobium or vanadium in amounts up to 0.1% by weight, wherein each of these additives can also be combined with nickel. However, within the scope of the invention, it is also possible to include similar recrystallization-retardantly effective additives in parts of up to 0.1% by weight of the alloy.

Furthermore, through the addition of up to 0.1% by weight of arsenic, antimony or phosphorous or, respectively, a combination of these elements, it is possible to improve the protection of the inventive brass material against dezincifying, as is the case with the usually employed additives for this purpose in the heretofore utilized brass alloys. The discrete distribution of the $\beta$ phase achieved by the precipitation of the $\beta$ or, respectively, $\beta_1$ phase from the $\alpha$ phase remains intact due to its extremely fine grain final distribution even during further processing at higher temperatures, so that the comprehensive protection of the $\alpha$ phase, surrouning the $\beta$ phase against dezincifying by means of the above-mentioned additives concurrently prevents a dezincifying of the $\beta$ phase.

Finally, elucidated hereinbelow by way of an example is the preparation of the inventive brass material, as well as its further processing into wires as the finished material for screws and springs.

Illustrative Example: Production of Wires

Utilized is an alloy having 62% by weight of copper, with the remainder being zinc. After the casting and the hot working through extruding, the material is subjected to an annealing in the range of the $\alpha$ solid solution, meaning, annealed for about 20 hours at 500° C. There is then formed a $\alpha$ solid solution only having a median grain diameter of about 150 $\mu$m. Through cold working, in this instance through swaging and drawing, a deformation of 98% is imparted to the material, which is possible without intermediate annealing. An annealing is thereafter carried out of the cold worked wires at a constant temperature of 250° C. over a period of 8 hours for effecting the precipitation of the $\beta_1$ phase. After the course of this time interval, there is present now a recrystallized structure of two phases with grain sizes of from 1 to 2 $\mu$m, whereby the $\beta_1$phase is embedded finely and discretely in the matrix of the $\alpha$ phase. The hardness of this material lies at about 165 HV.

Finally, the wires are again cold drawn to about an 80% degree of deformation. The wires thus evidence the following mechanical properties:

0.2% Yield strength: 780 N/mm$^2$

Tensile strength: 930 N/mm$^2$

Hardness: 260 HV

Reduction of Area: ~60%

What is claimed is:

1. In a brass material, the improvement in that said material comprises an alloy of 61 to 65% by weight of copper with the remainder being zinc; said material evidencing a structure in which the recrystallized phases $\alpha$ and $\beta_1$ are present as a discrete fine mixture having grain sizes of less than 5 $\mu$m, the component of the $\beta_1$ phase comprising at least 10%, of the structure and all of said phase being arranged in the form of a superfine distribution of discrete particles in the grain boundaries of the $\alpha$ phase.

2. Brass material as claimed in claim 1, said alloy including 62% by weight of copper with the remainder being zinc.

3. Brass material as claimed in claim 1 or 2, said $\beta_1$ phase component being about 10 to 50% of the structure.

4. Brass material as claimed in claim 1 or 2, said $\beta_1$ phase component being about 30 to 40% of the structure.

5. Brass material as claimed in claim 1 or 2, said material being adapted for the production of high-strength and highly ductile workpieces, wherein said material evidences the following mechanical properties:

Hardness (HV)>220

Tensile strength>800 N/mm$^2$ 0.2% Yield strength >600 N/mm$^2$.

* * * * *